US005791092A

United States Patent [19]

Strieter

[11] Patent Number: 5,791,092

[45] Date of Patent: Aug. 11, 1998

[54] NESTING CURB

[75] Inventor: Jool W. Strieter, Louisville, Ky.

[73] Assignee: Kentuckiana Curb Company, Inc., Louisville, Ky.

[21] Appl. No.: 671,326

[22] Filed: Jun. 27, 1996

[51] Int. Cl.[6] ..... F16M 11/00

[52] U.S. Cl. ..... 52/27; 52/200; 248/237; 248/678

[58] Field of Search ..... 52/27, 72, 173.1, 52/200, 292, 648.1, 651.11, 653.1, 656.1, 592.6; 62/259.1, DIG. 16; 248/174, 237, 676, 678

[56] References Cited

U.S. PATENT DOCUMENTS

| | | | |
|---|---|---|---|
| 1,021,782 | 4/1912 | Klein | 52/72 |
| 3,742,659 | 7/1973 | Drew | 52/27 X |
| 3,749,908 | 7/1973 | Esser et al. | 52/200 X |
| 3,878,655 | 4/1975 | Toth et al. | 52/27 |
| 3,896,595 | 7/1975 | Anginetti et al. | 52/72 X |
| 4,399,975 | 8/1983 | Trimarco et al. | 248/678 |
| 4,413,450 | 11/1983 | Brower | 52/27 |
| 4,428,166 | 1/1984 | Burghart | 52/72 X |
| 4,598,503 | 7/1986 | Berger et al. | 52/27 |
| 4,895,066 | 1/1990 | Carnahan | 62/259.1 X |
| 5,016,406 | 5/1991 | Calam et al. | 52/200 X |
| 5,188,333 | 2/1993 | Schumacher et al. | 248/676 |
| 5,465,533 | 11/1995 | Rummo, Jr. et al. | 248/676 X |

*Primary Examiner*—Carl D. Friedman
*Assistant Examiner*—Kevin D. Wilkens
*Attorney, Agent, or Firm*—Norman B. Rainer

[57] ABSTRACT

A curb for supporting equipment upon a roof is constructed as a rectangular box-like structure bounded by four side walls, adapted to be vertically positioned. Each side wall is constructed of an upper panel, and a lower panel outwardly displaced from the upper panel. A crown flange is associated with the top extremities of the upper panels. An outwardly directed base flange is associated with the bottom extremities of the lower panels. An outwardly directed shoulder extends in joinder between the bottom extremities of the upper panels and the top extremities of the lower panels. The shoulder is parallel to the crown flange and positioned half way between the crown and base flanges of the tallest side wall. The features of the curb are configured and dimensioned such as to permit nesting of a plurality of the curbs.

8 Claims, 2 Drawing Sheets

NESTING CURB

BACKGROUND OF THE INVENTION

1. Field of the Invention

This invention concerns a support, generally referred to as a "curb," for placement upon the roof of a building, and upon which a piece of equipment such as an air conditioning unit is mounted.

2. Description of the Prior Art

Curb devices are in commonplace use for supporting air conditioning units and other equipment upon a built-up roof, i.e., a roof having a water barrier layer such as asphalt, tar paper, etc. The curb is a box-like structure, generally fabricated of sheet metal or fiberglass panels, and is preferably installed on the roof during initial roof construction.

The relatively large size of the curb results in high cost for shipment between the curb manufacturing location and the sales or use location. The particular reason for the high transportation expense is that the curbs, even if neatly stacked, occupy considerable space which could otherwise be utilized for more valuable cargo. Because the curbs are relatively low cost items, higher shipping charges produce a significant percentage-wise increase in the delivered cost of the curb.

It is accordingly an object of the present invention to provide a curb which will enable a multitude of said curbs to occupy less space than a similar number of conventional curbs.

It is another object of this invention to provide a curb as in the foregoing object which is of durable construction and amenable to low cost manufacture.

These objects and other objects and advantages of the invention will be apparent from the following description.

SUMMARY OF THE INVENTION

The above and other beneficial objects and advantages are accomplished in accordance with the present invention by a curb for supporting equipment upon a roof, said curb comprising:

a) four side walls joined to form a rectangular box-like structure having an interior region, said side walls adapted to be vertically positioned and comprised of parallel upper and lower panels which terminate in straight top and bottom extremities, said lower panels being disposed outwardly from said interior region with respect to said upper panels, said curb having a plane of symmetry that perpendicularly bisects two opposed side walls, b) a crown flange associated with the top extremities of said upper panels as a circuitous planar strip, c) an outwardly directed base flange associated with the bottom extremities of said lower panels as a surrounding planar rectangular strip adapted to rest upon a roof, and d) an outwardly directed shoulder extending in joinder between the bottom extremities of the upper panels and the top extremities of the lower panels and defining a surrounding planar strip disposed in parallel relationship to said crown flange and positioned half way between the crown and base flanges of the tallest side wall, as measured vertically between base and crown flanges within said plane of symmetry, e) whereby nesting of a multitude of said curbs can be achieved wherein the shoulder of one curb rests in abutment with the crown flange of the next lower curb.

In some embodiments, the crown and base flanges are disposed in parallel relationship. In other embodiments, the base flange is angled with respect to the crown flange in order to accommodate a sloped roof.

BRIEF DESCRIPTION OF THE DRAWING

For a fuller understanding of the nature and objects of the invention, reference should be had to the following detailed description taken in connection with the accompanying drawing forming a part of this specification and in which similar numerals of reference indicate corresponding parts in all the figures of the drawing.

DESCRIPTION OF THE PREFERRED EMBODIMENTS

Figure 1:
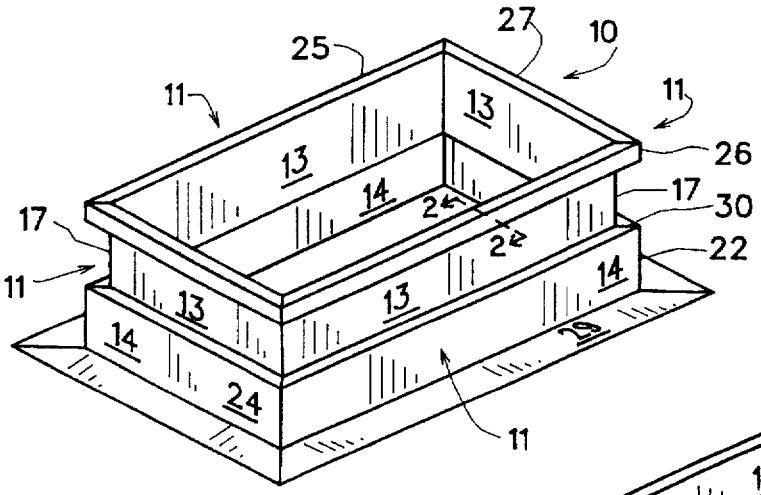
FIG. 1 is a perspective view of an embodiment of the nesting curb of the present invention.
Figure 5:
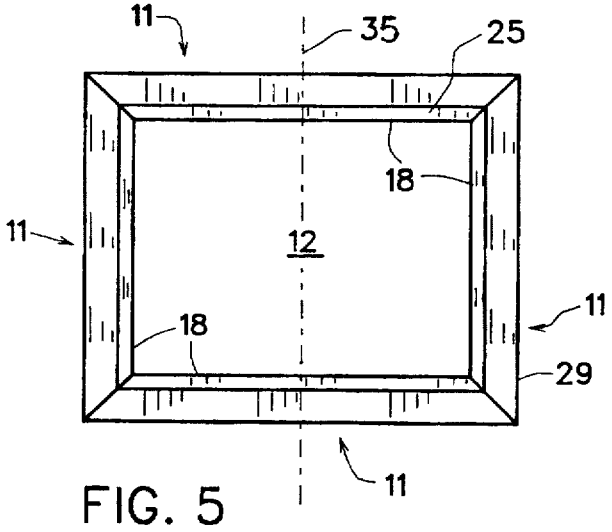
FIG. 5 is a top plan view of the embodiment of FIG. 1.
Figure 2:
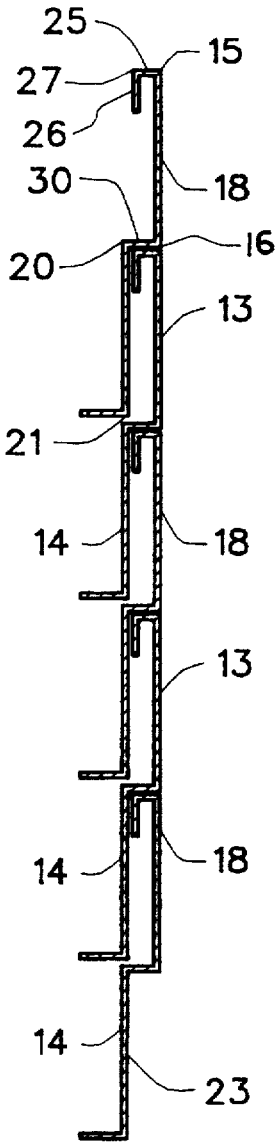
FIG. 2 is an enlarged fragmentary sectional view taken in the direction of the arrows upon lines 2—2 of FIG. 1 and showing a multitude of identical curbs in nested relationships.

Referring to FIGS. 1, 2, and 5, an embodiment of the nesting curb 10 of the present invention is shown comprised of four side walls 11 joined to form a rectangular box-like structure having an interior region 12.

Side walls 11 are adapted to be vertically positioned, and are comprised of upper and lower panels 13 and 14, respectively, which are disposed in parallel planes. Upper panels 13 are bounded by straight top and bottom extremities 15 and 16, respectively, and opposed straight side edges 17, producing a rectangular perimeter. Said upper panels are further characterized in having interior and exterior surfaces 18 and 19, respectively. The four upper panels 13 are joined at their side edges 17, thereby forming vertically oriented corners of the curb.

Figure 4:
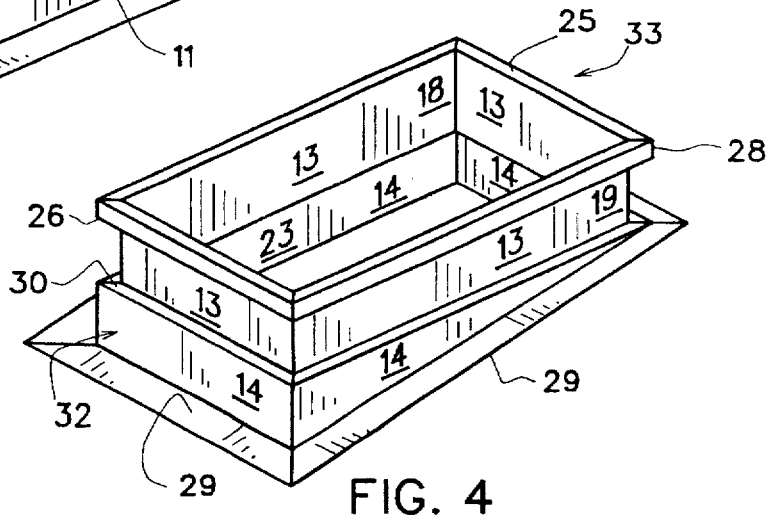
FIG. 4 is a perspective view of a first alternative embodiment of the nesting curb of this invention.

Lower panels 14 are bounded by straight top and bottom extremities 20 and 21, respectively, and opposed straight side edges 22, and are further characterized in having interior and exterior surfaces 23 and 24, respectively. Lower panels 14 are disposed outwardly from said interior region with respect to the corresponding upper panels 13 by a distance between about 1 and 3 inches. Said four lower panels are joined at their side edges 22 to form vertically oriented corners. Although said lower panels may have a rectangular perimeter, certain embodiments may have a bottom extremity that is angled with respect to the corresponding top extremity, as shown in FIG. 4. Said upper and lower panels are preferably of sheet metal construction.

Figure 7:
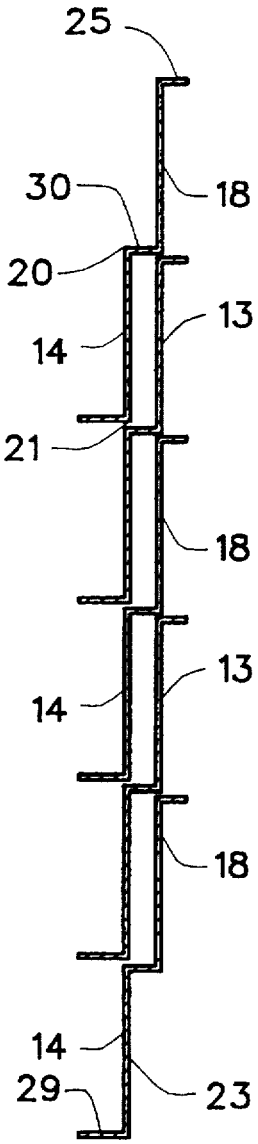
FIG. 7 is a fragmentary vertical sectional view of a nested array of a second embodiment of curb of the present invention.

An outwardly directed crown flange 25 is associated with the top extremities of upper panels 13 of the embodiment of FIG. 1. Said crown flange is essentially a planar rectangular strip of constant width that surrounds side walls 11, and is adapted to be horizontally positioned. The function of said crown flange is to securely support equipment such as air conditioning components. Said crown flange may accordingly have, or be made to have, apertures to receive securing bolts. The crown flange is preferably a continuous integral extension of the corresponding upper panel, having been formed by way of a bending operation. In the second embodiment of the curb of this invention, as shown in FIG. 7, crown flange 25 is inwardly directed.

A downwardly directed lip 26 is often associated with the distal edge 27 of an outwardly directed crown flange 25 as a continuous integral extension having been formed by bending. The lips 26 associated with the four upper panels are joined as by welding at their lateral extremities 28. The function of lip 26 is to add strength to the curb structure and to provide a flashing surface which keeps water from dripping directly onto the lower portions of the curb.

An outwardly directed base flange 29 is associated with the bottom extremities of lower panels 14 as a surrounding planar rectangular strip of uniform width. Said base flange, which may be formed by way of bending, is orthogonally disposed to said lower panels. The embodiment of the curb shown in FIG. 1 has parallel crown and base flanges. Although generally intended for use on flat roofs, such embodiment can also be employed on sloped roofs, but in which case the equipment supported by the curb will not be horizontally disposed. In the first alternative embodiment of the curb of this invention shown in FIG. 4 and adapted for use on a sloped roof, the base flange is angled with respect to the crown flange. The function of the base flange is to facilitate securement to an underlying roof structure.

An outwardly directed shoulder 30 extends in joinder between the bottom extremities 16 of upper panels 13 and the top extremities 20 of lower panels 14. Said shoulder is a planar strip of constant width that encircles the four sidewalls 11 in parallel disposition to crown flange 25 at a location which is half way between said crown and base flanges. The width of the shoulder,measured orthogonally to sidewall 11, is slightly greater than the similarly measured width of the crown flange. The overall construction of the curb is such as to possess at least one plane of symmetry, represented by broken line 35 in FIG. 5, said plane of symmetry perpendicularly bisecting opposed sidewalls 11.

By virtue of the aforesaid critical construction, a multitude of curbs of this invention can be disposed in nested relationship, as shown in FIG. 2. In achieving the nested state, that portion of the interior of a curb which is associated with said lower panels slides in sleeve-like fashion over the exterior of the upper panel portion of the next lower curb. When nested, the shoulder of one curb rests in abutment with the crown flange of the next lower curb.

Figure 3:
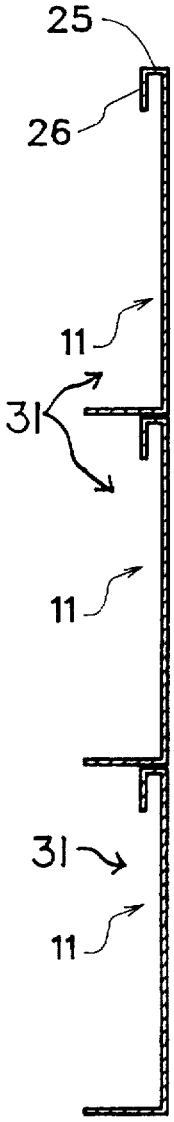
FIG. 3 PRIOR ART
FIG. 3 is a view similar to FIG. 2 showing a series of prior art curbs in stacked relationship.

Conventional curbs 31 of the prior art, when stacked as shown in FIG. 3 rest one atop another. By way of comparison, the nested curbs of this invention, shown in FIG. 2, occupy only about half the space as the stack of conventional curbs shown in FIG. 3. For ease of comparison, features of the prior art curbs of FIG. 3 are denoted by the same numerals as corresponding features of the curb of the present invention.

It is to be noted that the nest of curbs of FIG. 2 is such that the exterior is comprised of base flanges 29, and except for the uppermost curb, lower panels 14. The interior of the nest, except for the lowermost curb, is comprised entirely of upper panels 13.

Figure 6:
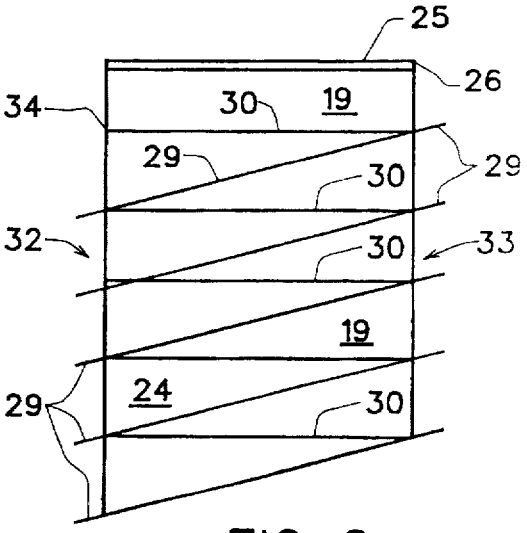
FIG. 6 is a side view of a nested assembly of the alternative curb embodiment of FIG. 4.

In the sloped curb embodiment of FIG. 4, the tallest wall 32, measured vertically between the corresponding crown and base flanges within said plane of symmetry, is considered to be a front side wall. In such embodiments, shoulder 30 is at the mid-height location of said front side wall, and extends to a rear side wall 33 in parallel juxtaposition to crown flange 25. In the nested state of sloped curbs, shown in FIG. 6, portions of the upper panels are apparent on the exterior of the nest. For transportation purposes, the lowermost extremity of the nest of FIG. 6 may be shored to compensate for the angled configuration. Alteratively, the nest may be transported in an upside down state whereby the crown flange of the first curb in the nest rests upon the floor of the transporting vehicle.

While particular examples of the present invention have been shown and described, it is apparent that changes and modifications may be made therein without departing from the invention in its broadest aspects. The aim of the appended claims, therefore is to cover all such changes and modifications as fall within the true spirit and scope of the invention.

Having thus described my invention, what is claimed is:

1. A nested array of a multitude of identical curbs intended for supporting equipment upon a roof, each curb comprising:

a) four side walls of equal height joined to form a rectangular box-like structure having an interior region, said side walls adapted to be vertically positioned and comprised of parallel upper and lower panels which terminate in straight top and bottom extremities, said lower panels being disposed outwardly from said interior region with respect to said upper panels, said curb having a plane of symmetry that perpendicularly bisects two opposed side walls, b) a crown flange associated with the top extremities of said upper panels as a circuitous planar strip, c) an outwardly directed base flange associated with the bottom extremities of said lower panels as a surrounding planar rectangular strip adapted to rest upon a roof, and d) an outwardly directed shoulder extending in joinder between the bottom extremities of the upper panels and the top extremities of the lower panels and defining a surrounding planar strip disposed in parallel relationship to said crown flange and positioned half way between the crown and base flanges, e) whereby nesting of a multitude of said curbs is achieved wherein the shoulder of one curb rests in abutment with the crown flange of the next lower curb.

2. The array of claim 1 wherein the width of said shoulder is slightly greater than the width of said crown flange.

3. The array of claim 1 wherein said crown flange is a continuous integral extension of said upper panels, having been formed by way of a bending operation.

4. The array of claim 1 wherein said crown and base flanges are disposed in orthogonal relationship to said side walls.

5. The array of claim 4 wherein said crown and base flanges are disposed in parallel relationship.

6. The array of claim 5 wherein said crown flange is interiorly directed.

7. The array of claim 5 wherein said crown flange is exteriorly directed, and terminates in a distal edge.

8. The array of claim 7 wherein a downwardly directed lip is associated with the distal edge of said crown flange.

* * * * *